US005718508A

United States Patent [19]

Williams

[11] Patent Number: 5,718,508

[45] Date of Patent: Feb. 17, 1998

[54] SELF-CLEANING MIXER FOR CEMENT SLURRY

[75] Inventor: Harold V. Williams, Tempe, Ariz.

[73] Assignee: Haltec Corporation, Scottsdale, Ariz.

[21] Appl. No.: 739,410

[22] Filed: Oct. 29, 1996

[51] Int. Cl.[6] ..... B01F 15/00

[52] U.S. Cl. ..... 366/138; 366/40; 366/50; 366/64; 366/168.1; 366/169.1

[58] Field of Search ..... 366/10, 13, 34, 366/40, 50, 64, 138, 167.1, 168.1, 169.1, 169.2, 279, 318, 320

[56] References Cited

U.S. PATENT DOCUMENTS

| | | | |
|---|---|---|---|
| 832,722 | 10/1906 | Ham et al. | 366/40 |
| 1,753,716 | 4/1930 | Owen . | |
| 1,763,122 | 10/1930 | Bailey | 366/169.1 |
| 2,595,631 | 5/1952 | Bertsch . | |
| 3,236,147 | 2/1966 | Green | 366/40 |
| 3,459,409 | 8/1969 | Goldberger | 366/40 |
| 4,194,925 | 3/1980 | Holbrook et al. | 366/40 |
| 4,329,063 | 5/1982 | Edwards | 366/64 |
| 4,551,024 | 11/1985 | Clapp | 366/50 |
| 5,352,035 | 10/1994 | Macaulay et al. | 366/15 |
| 5,427,448 | 6/1995 | Macaulay et al. | 366/6 |
| 5,513,911 | 5/1996 | Schwing | 366/169.1 |
| 5,620,251 | 4/1997 | Funder et al. | 366/169.1 |

FOREIGN PATENT DOCUMENTS

| | | | |
|---|---|---|---|
| 1625708 | 2/1991 | U.S.S.R. | 366/40 |

*Primary Examiner*—Tony G. SooHoo
*Attorney, Agent, or Firm*—Cahill, Sutton & Thomas, P.L.C.

[57] ABSTRACT

A self-cleaning mixer includes a cylindrical housing and a feedscrew extending longitudinally through the housing for mixing water and cement and conveying the slurry through the housing. A chute at the infeed end of the housing receives a batch of material and directs the material into the housing. The feedscrew turns on a hollow shaft including a plurality of outwardly directed nozzles along a portion of the length of the shaft. The housing includes a plurality of inwardly directed nozzles fed from a pair of manifolds. During a cleaning cycle, one of the manifolds is shut off, thereby increasing the water pressure in the other manifold and increasing the force of the spray to enhance cleaning. The housing is slightly inclined to provide gravity feed of slurry in addition to the feedscrew.

14 Claims, 2 Drawing Sheets

SELF-CLEANING MIXER FOR CEMENT SLURRY

BACKGROUND OF THE INVENTION

This invention relates to a mixer for a slurry of mortar or cement and, in particular, to a self-cleaning mixer.

As known in the art, dry cement is a fine powder and the transfer of cement from a storage silo to a truck can produce a great deal of dust, which is environmentally undesirable. One approach taken in the prior art is to mix the cement with water prior to transfer, thereby greatly reducing the production of dust.

A problem with exposing cement to moisture is the tendency of the cement particles to agglomerate and to adhere to any convenient surface. The result has been a significant downtime associated with cleaning the mixing apparatus, often after only three or four trucks have been loaded. A thorough cleaning, including disassembly of the mixer, must be done at least weekly and, occasionally, daily.

Another problem with a slurry of cement is the time required for filling a truck. After each truck is filled, the system is checked for problems and cleaned as necessary. The filling time and the time between fills determine how many trucks can be serviced per hour. It is desired to minimize the time required to load a truck with slurry and to minimize the time between loads.

Mixers typically include a hopper for receiving material at one end of a cylinder containing a feedscrew for mixing the material and conveying the material to the other end of the cylinder. U.S. Pat. No. 1,753,716 (Owen) discloses such a system for continuously mixing cement slurry. The mixer includes a feedscrew at the supply end of the cylinder and a plurality of mixing paddles on a common shaft with the feedscrew at the outlet end of the cylinder. Water is fed from a single nozzle at the juncture of the feedscrew and the paddles.

U.S. Pat. No. 2,595,631 (Bertsch) discloses apparatus for spraying water on materials prior to mixing and for adding water to a mixing tank. U.S. Pat. No. 5,352,035 (Macaulay et al.) discloses a mixer having feedscrews in split, folded paths that enables unmixed material to be sent directly to a final mixing chamber in the event of equipment failure. It is also disclosed that water is added from a plurality of nozzles along the paths, wherein the nozzles are fed from a manifold and produce an overlapping spray pattern. None of the systems in the prior art is self-cleaning or capable of providing a rapid, thorough mixing of the cement.

In view of the foregoing, it is therefore an object of the invention to provide a self-cleaning mixer that requires maintenance once per week or even less frequently.

Another object of the invention is to provide a mixer capable of mixing cement with water and supplying a cement slurry to a truck in a minimum amount of time.

A further object of the invention is to provide a mixer capable of mixing and loading the cement for a nine cubic yard load in one minute or less.

Another object of the invention is to provide a self-cleaning mixer for cement in which the self-cleaning cycle is part of the mixing cycle, thereby minimizing time between loads.

A further object of the invention is to provide a self-cleaning mixer for cement wherein the mixer can fully load one truck every three minutes or less.

Another object of the invention is to provide a mixer for cement requiring minimum maintenance.

SUMMARY OF THE INVENTION

The foregoing objects are achieved in this invention in which a self-cleaning mixer for cement includes a cylindrical housing and a feedscrew extending longitudinally through the housing for mixing water with the cement and conveying the slurry through the housing to an outfeed end. A chute at the infeed end of the housing receives material from a batch measuring device and directs the material into the housing. The feedscrew turns on a hollow shaft including a plurality of outwardly directed nozzles along a portion of the length of the shaft. The housing includes a plurality of inwardly directed nozzles fed from a pair of manifolds. Nozzles near the infeed end supply more water than the nozzles near the outfeed end of the housing. During a cleaning cycle, one of the manifolds is shut off, thereby increasing the water pressure in the other manifold and increasing the force of the spray to enhance cleaning. The water is metered to assure that the proper volume of water is provided for each batch of cement. A periodic rinse of approximately eighty seconds duration completely cleans the mixer, reducing maintenance to weekly inspections.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
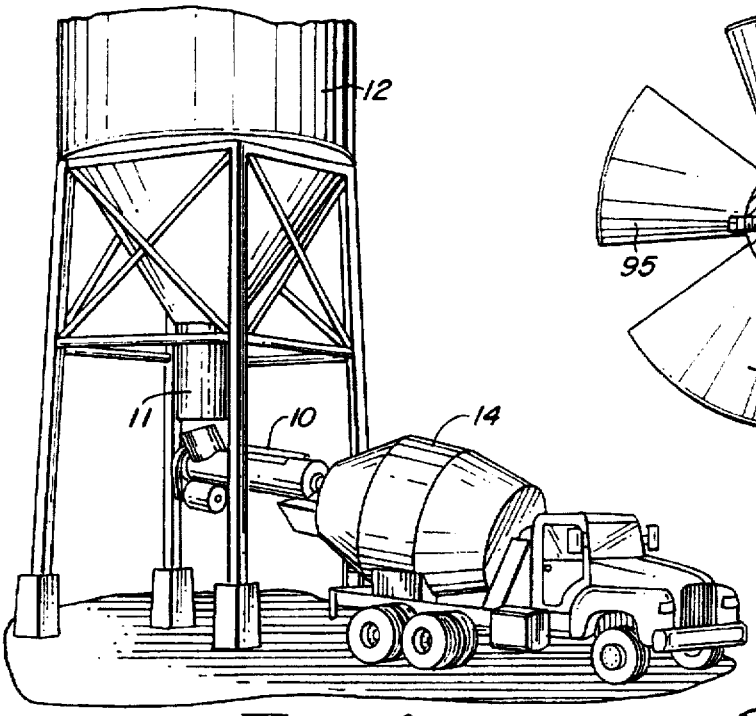
FIG. 1 illustrates a truck being loaded from a storage silo.

In FIG. 1, cement scale 11 stores the cement that is typically weighed in batches and loaded into a truck. Mixer 10 conveys the material from scale 11 of silo 12 to truck 14. A suitable mechanism (not shown) provides the desired mix of components for a particular load. In the prior art, a truck is loaded with nine cubic yards, approximately five thousand pounds, of cement in two or three minutes. Mixers of the prior art typically clog and must be cleaned after each load, greatly reducing the number of trucks that can be loaded per hour from a storage silo. Mixer 10, constructed in accordance with the invention, provides a cement slurry to truck 14, fully loading truck 14 in approximately one minute. In addition, mixer 10 is self-cleaning and is ready for the next truck as soon as the truck can be positioned.

Figure 2:
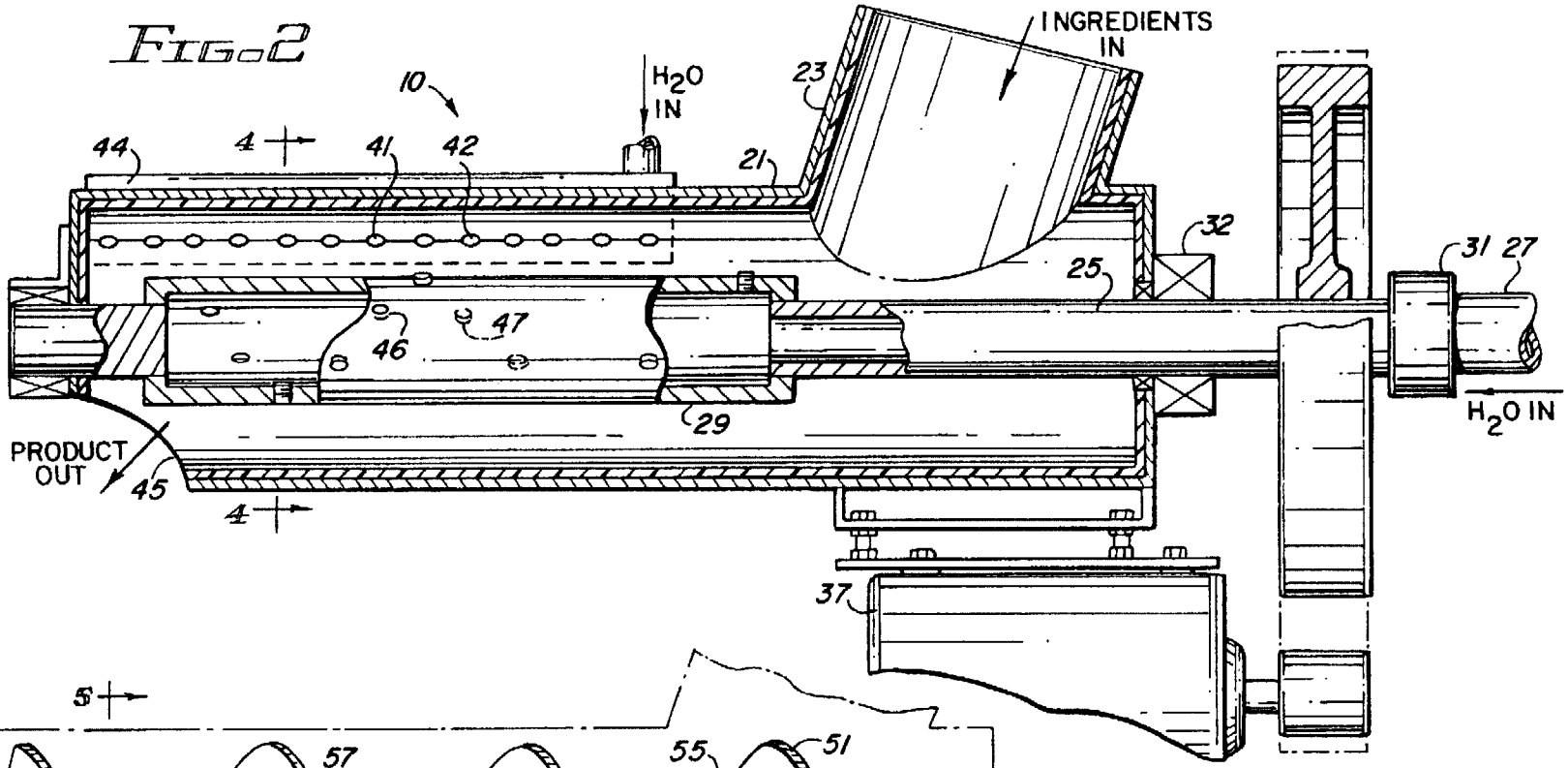
FIG. 2 is a cross-section of a mixer constructed in accordance with the invention, showing the water injection system.

FIG. 2 is a cross-section of a mixer constructed in accordance with the invention, emphasizing the water delivery components of the system. Specifically, mixer 10 includes cylindrical metal housing 21 coupled to infeed chute 23 for coupling mixer 10 to scale 11 (FIG. 1). The ends of housing 21 are closed and the housing encloses hollow shaft 25. Hollow shaft 25 conveys water from a suitable source (not shown) coupled at end 27 through rotating seal 31 and bearing 32. Shaft 25 is rotated by motor 37, which is connected to shaft 25 by a pulley or other suitable mechanism.

Housing 21 includes a plurality of nozzles, such as nozzles 41 and 42, fed by manifold 44 for directing a plurality of overlapping sprays inwardly to the mixture, forming a slurry. The inwardly directed nozzles attached to housing 21 are preferably located along the downstream half of housing 21, that is, the last half of the cylinder traversed by the cement mixture as it moves from infeed chute 23 to outfeed 45. Outfeed 45 is positioned over the receiving cone of a cement truck.

Figure 3:
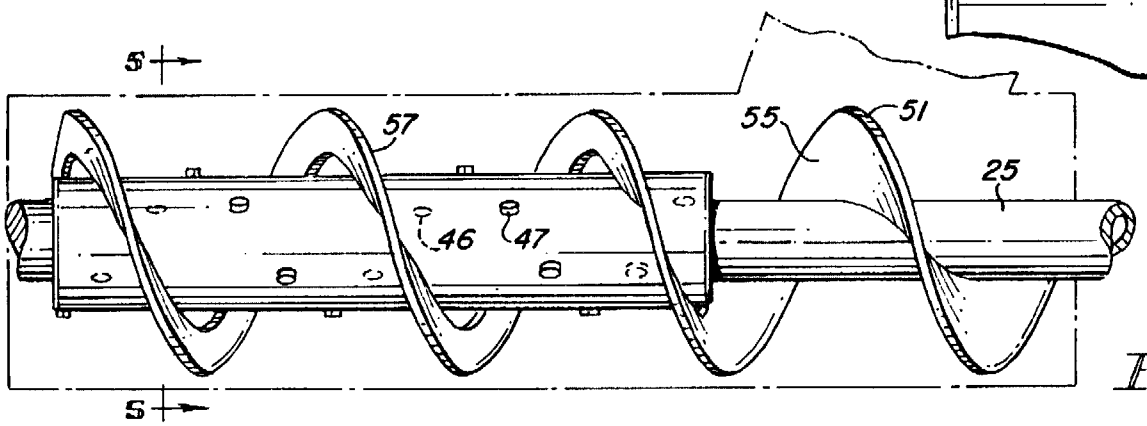
FIG. 3 is a side view of the central shaft in the mixer, showing the mixing vanes relative to the water nozzles.

Water fed through hollow shaft 25 passes through a plurality of nozzles, such as nozzles 46 and 47, that direct the spray radially outwardly into the cement slurry. Preferably, the nozzles on shaft 25 are located along a helical path on the outer surface of shaft 25. FIG. 3 illustrates the relationship between the outwardly directed nozzles and the feed screw on shaft 25. Shaft 25 includes screw 51 extending substantially the entire length of shaft 25 within housing 21. The outwardly directed nozzles are located approximately midway between successive turns of screw 51.

Figure 4:
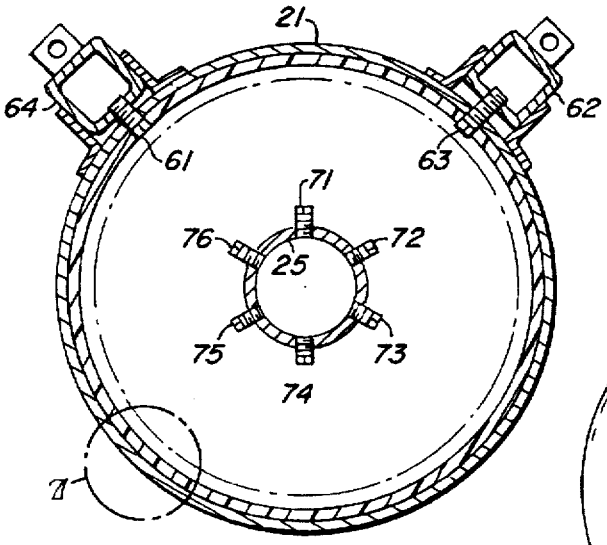
FIG. 4 is a cross-section along lines 4—4 in FIG. 2.

FIG. 4 is a cross-section of mixer 10, showing the opposed nozzles in the mixer. There are preferably two sets of inwardly directed nozzles. Manifold 44 is coupled to a set of nozzles, including nozzle 61. Manifold 62 is coupled to a second set of nozzles, including nozzle 63. Manifold 44 and manifold 62 preferably extend along the length of housing 21, parallel to the longitudinal axis thereof. Nozzles 61 and 63 are preferably located at right angles to each other and direct their respective sprays at right angles to each other. As illustrated in FIG. 4, shaft 25 includes a plurality of nozzles, 71–76, located approximately every 60° around the diameter of shaft 25. Four to eight nozzles could be used around the diameter of shaft 25, preferably regularly spaced. A single set of inwardly directed nozzles could be used but it is preferred that at least two sets of inwardly directed nozzles be used in order to supply a sufficient volume of water and to disperse the water throughout the mixture to produce as uniform a mixture as possible.

In operation, a measured batch of cement is loaded into infeed chute 23 while shaft 25 turns and water is directed through the nozzles into the mixture to produce a slurry. In a preferred embodiment of the invention, the nozzles are on two inch centers and the nozzles near the outfeed end have a smaller flow than the remaining nozzles, e.g. five of sixteen nozzles had a flow capacity of 1–2 gpm. (gallons per minute) and the remaining eleven nozzles had a flow capacity of six gpm. The quantity of water is metered and when the appropriate volume of water has been provided for a given mix, the water is shut off. As soon as one truck has left the silo, another can be loaded because of the self-cleaning nature of the mixer.

Periodically through the day, it is preferred to rinse the mixer by running the mixer with no cement mixture. Approximately one hundred and fifty gallons of water sprayed into the mixer for approximately eighty seconds has been found sufficient to clean the mixer thoroughly. This represents a significant reduction in water consumption, compared with mixers of the prior art that not only require more water but require disassembly and a significant amount of downtime for cleaning. It is preferred to shut off the water to one of manifolds 44 and 62, thereby increasing the pressure in the remaining manifold and increasing the velocity of the water sprayed into housing 21. The increase in pressure assures that agglomerates are flushed from the mixer.

In one embodiment of the invention, housing 21 had an inside diameter of approximately fifteen inches and an overall length of fifty-seven inches. Shaft 25 rotated at approximately 280 rpm. Each manifold fed sixteen nozzles and most nozzles had a maximum flow of six gallons/minute, as described above. The axis of housing 21 is preferably tipped out of a horizontal plane by 5°–15° with the outfeed end lower than the infeed end. That is, infeed chute 23 is approximately vertical.

Figure 5:
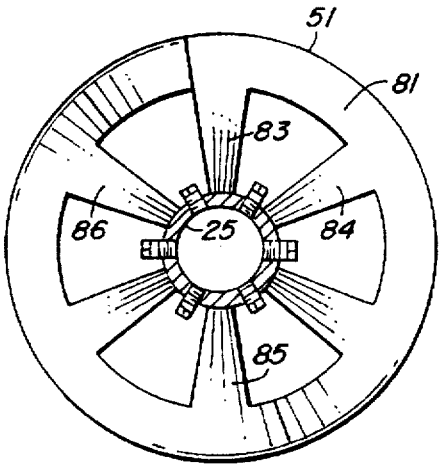
FIG. 5 is a cross-section along lines 5—5 in FIG. 3.

FIG. 5 is an end view of screw 51, showing the preferred structure of the screw. Screw 51 provides both a feed function and a mixing function. The feed function is provided primarily by outer ribbon 81 and the mixing function is provided primarily by struts 83–86. This combination has been found to provide the best configuration for mixing, transport, and self-cleaning. As illustrated in FIG. 3, the dry end of screw 51 includes helicoid 55, i.e. the right-hand portion of the screw is a continuous surface from root to edge, and the left-hand end portion of screw 51 included ribbon 57. In one embodiment of the invention, screw 51 had a twelve inch pitch and a ribbon one inch wide.

Figure 6:
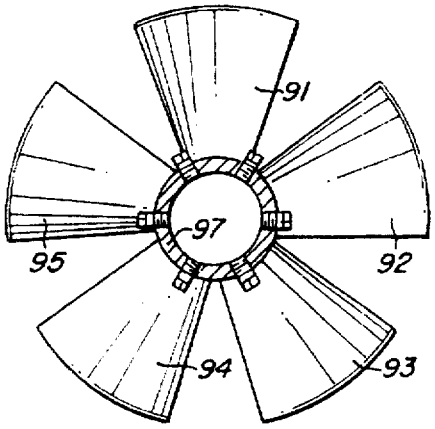
FIG. 6 illustrates an alternative embodiment of the invention in which paddles are substituted for the mixing screw.

FIG. 6 illustrates an alternative embodiment of the invention, wherein a plurality of paddles, such as paddles 91–95 are located about the diameter of hollow shaft 97. The paddles mix and transport the slurry through the housing. The number of paddles per turn of shaft 97 is independent of the number of nozzles per turn of the shaft.

Figure 7:
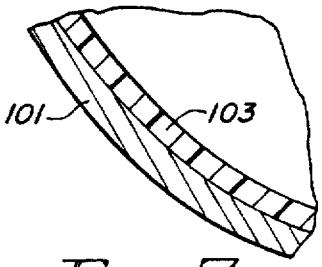
FIG. 7 is a detail showing the plastic lining on the interior of the housing.

FIG. 7 is a cross-section of a portion of housing 21. Housing 21 preferably includes a metal outer wall 101, such as steel or aluminum, and a non-stick lining or coating 103. In one embodiment of the invention, coating 103 was made from Kynar plastic. This material has been found to be durable in the abrasive environment of a cement slurry and relatively non-stick, such that damp, cement dust does not form agglomerates readily on coating 103. Other coatings can be used instead, such as an electrostatic powder that is applied and then baked at high temperature, causing the electrostatically adherent particles to fuse together and to bond with the surface of the metal.

The invention thus provides a self-cleaning mixer that requires maintenance once per week, or even less frequently, by virtue of the sprays and internal construction of the mixer. A truck can be filled in a minimum amount of time and part of the mixing cycle also cleans the mixer, thereby minimizing downtime between loads.

Having thus described the invention, it will be apparent to those of skill in the art that various modifications can be made within the scope of the invention. For example, although described in the context of loading trucks from a silo, a mixer constructed in accordance with the invention can be used in other applications, e.g. as a portable mixer for continuous, on-site mixing of gypsum concrete for floors. The feedscrew can be a helicoid from end to end and can be double threaded, i.e. interleaved helicoids, over some or all its length. The rinse cycle can include shutting off manifolds 44 and 62, then turning on one of the manifolds and shutting off the flow through hollow shaft 25 or various other combinations of flows to rinse the mixer. One can store, filter, and re-cycle the rinse water to reduce consumption even more. Hollow shaft 25 can be a single tube or, preferably, includes enlarged portion 29 that acts as a plenum to assure that the water pressure at all the nozzles is approximately the same.

What is claimed as the invention is:

1. A self-cleaning mixer for cement slurry, said mixer comprising:

a cylindrical housing having an infeed end and an outfeed end spaced along a first axis;

a feedscrew within said housing for moving material from said infeed end to said outfeed end, said feedscrew including a hollow shaft;

a first set of nozzles directed inwardly from said housing to said feedscrew; and a second set of nozzles directed outwardly from said hollow shaft to said housing.

2. The self-cleaning mixer as set forth in claim 1 and further comprising;

a first manifold parallel with said axis, said first manifold feeding said first set of nozzles.

3. The self-cleaning mixer as set forth in claim 1 wherein said first set of nozzles includes nozzles having a first flow capacity and nozzles having a second flow capacity, wherein said second flow capacity is lower than the first flow capacity.

4. The self-cleaning mixer as set forth in claim 3 wherein said nozzles having a second flow capacity are located nearer said outfeed end than the nozzles having a first flow capacity.

5. The self-cleaning mixer as set forth in claim 1 wherein said second set of nozzles includes nozzles having a first flow capacity and nozzles having a second flow capacity, wherein said second flow capacity is lower than the first flow capacity.

6. The self-cleaning mixer as set forth in claim 5 wherein said nozzles having a second flow capacity are located nearer said outfeed end than the nozzles having a first flow capacity.

7. The self-cleaning mixer as set forth in claim 1 wherein said feedscrew includes a ribbon helix and a helicoid.

8. The self-cleaning mixer as set forth in claim 7 wherein said ribbon helix is located nearer said outfeed end than said helicoid.

9. The self-cleaning mixer as set forth in claim 1 wherein said housing includes a plastic liner.

10. The self-cleaning mixer as set forth in claim 1 and further comprising:

a third set of nozzles directed inwardly from said housing to said feedscrew; and a second manifold parallel with said axis, said second manifold feeding said third set of nozzles.

11. The self-cleaning mixer as set forth in claim 10 wherein said second manifold is located approximately 90° away from said first manifold about said first axis.

12. The self-cleaning mixer as set forth in claim 1 wherein said second set of nozzles are located along a helical path on said hollow shaft.

13. The self-cleaning mixer as set forth in claim 12 wherein said second set of nozzles are regularly spaced along said helical path.

14. The self-cleaning mixer as set forth in claim 13 wherein said feedscrew includes a ribbon helix and a helicoid and said second set of nozzles is located along said ribbon helix.

* * * * *